US006116965A

United States Patent [19]

Arnett et al.

[11] Patent Number: 6,116,965

[45] Date of Patent: Sep. 12, 2000

[54] LOW CROSSTALK CONNECTOR CONFIGURATION

[75] Inventors: Jaime Ray Arnett, Fishers; Julian Robert Pharney, Indianapolis, both of Ind.

[73] Assignee: Lucent Technologies Inc., Murray Hill, N.J.

[21] Appl. No.: 09/436,850

[22] Filed: Nov. 9, 1999

Related U.S. Application Data

[63] Continuation-in-part of application No. 09/031,807, Feb. 27, 1998.

[51] Int. Cl.[7] ..... H01R 13/04

[52] U.S. Cl. ..... 439/692; 439/941

[58] Field of Search ..... 439/607, 608, 439/609, 610, 692, 676, 668, 650, 651, 655, 941, 693, 694, 678, 677, 680, 682

[56] References Cited

U.S. PATENT DOCUMENTS

| | | | |
|---|---|---|---|
| 4,728,299 | 3/1988 | Worth . | |
| 4,850,887 | 7/1989 | Sugawara . | |
| 5,186,647 | 2/1993 | Denkmann . | |
| 5,399,107 | 3/1995 | Gentry . | |
| 5,766,040 | 6/1998 | Naerland . | |
| 5,871,378 | 2/1999 | Poiraud et al. | 439/676 |

FOREIGN PATENT DOCUMENTS

| | | |
|---|---|---|
| 0 598 192 A1 | 9/1993 | European Pat. Off. . |
| 0 708 501 A1 | 4/1996 | European Pat. Off. . |
| 0 755 100 A2 | 1/1997 | European Pat. Off. . |
| 0 782 221 A2 | 7/1997 | European Pat. Off. . |
| WO 96/42123 | 12/1996 | WIPO . |

OTHER PUBLICATIONS

The Siemon Company, Internet Advertisement for "Category 7 Connector" (4 pages—undated).

C.S. Walker; Capacitance, Inductance and Crosstalk Analysis, Artech House (1990), pp. 66–67, 100–103.

*Primary Examiner*—Paula Bradley
*Assistant Examiner*—Ross Gushi
*Attorney, Agent, or Firm*—Law Office of Leo Zucker

[57] ABSTRACT

A low crosstalk connector configuration includes a terminal face, and at least three pairs of elongated parallel electrical connector terminals, wherein each pair is aligned in a plane normal to the terminal face. A first pair of terminals is aligned in a plane parallel to a second plane in which a second pair of terminals is aligned. A first distance between midpoints of the first and the second pairs of terminals in a direction parallel to the first and the second planes, equals a second distance between the midpoints in a direction perpendicular to the first and the second planes. A third pair of terminals is aligned in a third plane perpendicular to the first and the second planes. The third plane coincides with a point between either of the first or the second pair of terminals. A cable and connector assembly includes a length of cable with at least three pairs of twisted wires, with each wire pair connected to a corresponding pair of the connector terminals.

36 Claims, 5 Drawing Sheets

LOW CROSSTALK CONNECTOR CONFIGURATION

CROSS REFERENCE TO RELATED APPLICATION

This application is a continuation-in-part of our co-pending U.S. application Ser. No. 09/031,807 filed Feb. 27, 1998.

BACKGROUND OF THE INVENTION

1. Field of the Invention

The present invention relates to configurations for electrical connectors that tend to reduce or cancel crosstalk between terminals of the connectors, and particularly to a low crosstalk terminal configuration for jack and plug connectors in high-data rate wired networks.

2. Discussion of the Known Art

Presently, telephone modular plug and jack connectors are used in many communication systems as a primary means for connecting copper wire to equipment. Such connectors, referred to in the industry as, e.g., type RJ-45 connectors, usually have four pairs of connector terminals. The known plugs and jacks are also used to provide simple and reliable connections between lengths of cable carrying one or more twisted pairs of copper wire conductors. The modular plug and jack connection configuration has become a global standard. The mounting size of a type RJ-45 jack frame measures about 0.650 inches by 0.600 inches.

Currently, there is a concern in the connector industry over improving crosstalk performance of the modular type telephone plugs and jacks, especially to allow existing copper cable systems to compete with optical fiber networks. See, for example, U.S. Pat. No. 5,399,107 (Mar. 21, 1995); and U.S. Pat. No. 5,186,647 (Feb. 16, 1993). But characteristics inherent to the existing modular connector interface, tend to limit the amount of crosstalk reduction that can be achieved when using the connectors with copper cable systems. It would therefore be desirable to provide a plug and jack connector interface that excels in crosstalk performance relative to current modular connector designs. Preferably, such an interface should occupy a cross-section no greater than that of current modular connectors so that large scale field replacements can be easily carried out.

Crosstalk is a function of, among other things, the spacing of individual connector terminals from one another, the relative orientation of the terminal pairs, the spacing of the terminal pairs from one another, and the dielectric properties of a connector body in which the connector terminals are held in position. See, e.g., C. S. Walker; Capacitance, Inductance, and Crosstalk Analysis; Artech House (1990), at pages 66–67 and 100–103.

U.S. Pat. No. 5,766,040 (Jun. 16, 1998) discloses a plug and jack contact set for twisted pair cable, wherein contact pins for each wire pair are individually shielded by the plug and the jack connectors of the set. Each pair of contact pins is located adjacent an outer shield cover of the associated connector, to maximize the spacing between pairs of contact pins on the connector. A so-called "Category 7" connector set with shielding about individual pairs of contact pins, is also offered by The Siemon Company. It would of course be desirable to provide a low crosstalk connector configuration that can be applied to existing wire networks without shielding, and nonetheless obtain a high level of crosstalk performance.

SUMMARY OF THE INVENTION

According to the invention, a connector has a connector terminal face, and at least three pairs of elongated parallel electrical connector terminals, wherein each pair is aligned in a plane normal to the terminal face. A first pair of terminals is aligned in a first plane substantially parallel to a second plane in which a second pair of terminals is aligned. A first separation distance between midpoints of the first and the second pairs of terminals in a direction parallel to the first and the second planes, is substantially equal to a second separation distance between the midpoints in a direction perpendicular to the first and the second planes. A third pair of terminals is aligned in a third plane perpendicular to the first and the second planes, and the third plane coincides with a point between either of the first or the second pair of terminals.

According to another aspect of the invention, a cable and connector assembly includes a length of cable having at least three pairs of twisted wires, and a connector attached at one end of the cable. The connector has a connector terminal face and at least three pairs of elongated parallel electrical connector terminals, wherein each pair is aligned in a plane normal to the terminal face. A first pair of terminals is aligned in a first plane substantially parallel to a second plane in which a second pair of terminals, is aligned. A first separation distance between midpoints of the first and the second pairs of terminals in a direction parallel to the first and the second planes, is substantially equal to a second separation distance between the midpoints in a direction perpendicular to the first and the second planes. A third pair of terminals is aligned in a third plane perpendicular to the first and the second planes, and the third plane coincides with a point between either of the first or the second pair of terminals. The twisted pairs of wires of the cable are electrically connected to corresponding pairs of the connector terminals.

For a better understanding of the invention, reference is made to the following description taken in conjunction with the accompanying drawing and the appended claims.

DETAILED DESCRIPTION OF THE INVENTION

Figure 1:
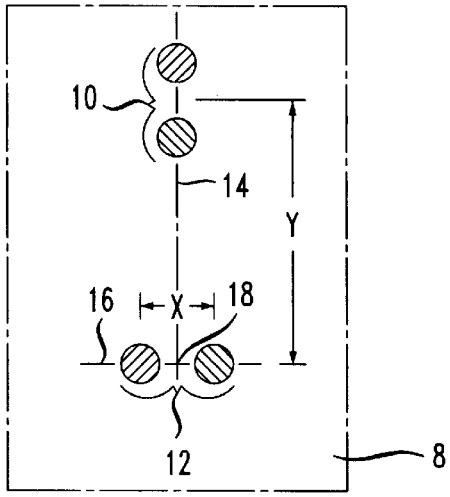
FIG. 1 is a cross-sectional representation of a first low crosstalk configuration for two pairs of electrical connector terminals.
Figure 2:
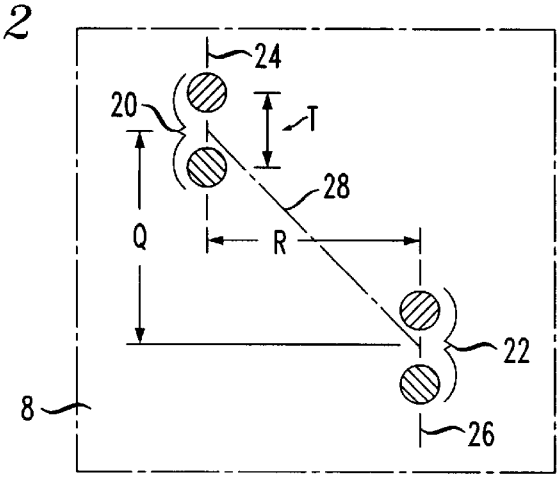
FIG. 2 is a cross-sectional representation of a second low crosstalk configuration for two pairs of connector terminals.

FIGS. 1 and 2 are cross-sections of configurations of pairs of elongated, parallel electrical connector terminals, which configurations are embodied in the present invention. Front ends of the terminals may be nearly flush with a connector terminal face 8 in the plane of the drawing, or the terminals may extend from the terminal face in a direction normal to (i.e., out of) the view of FIGS. 1 and 2.

In FIG. 1, two pairs 10, 12 of connector terminals are positioned such that a spacing X (e.g., 0.100 inches) between the terminals of each pair is small relative to a distance Y (e.g., 0.400 inches) that separates midpoints of the terminal pairs 10, 12. Also, the terminals of the pair 10 are aligned in a respective plane 14 that is substantially perpendicular to a plane 16 containing the terminals of the pair 12, and the plane 14 coincides with a midpoint 18 between the terminal pair 12.

With the configuration of FIG. 1, it has been found that any crosstalk between the two terminal pairs 10, 12 is substantially eliminated or very minimal. See FIG. 6. That is, voice/data signals transmitted or received through one terminal pair 10 or 12; are not coupled into the other terminal pair 12 or 10, to a significant degree.

In the configuration of FIG. 2, connector terminal pairs 20, 22 are each aligned in respective planes 24, 26 that are substantially parallel to one another. It has been found that crosstalk between the terminal pairs 20, 22 is nulled or minimized when a separation distance Q (e.g., 0.400 inches) between midpoints of the terminal pairs 20, 22 in a direction parallel to the planes 24, 26, is equal to a separation distance R (e.g., 0.400 inches) between the midpoints of the terminal pairs in a direction perpendicular to the planes 24, 26; with a spacing T (e.g., 0.100 inches) between the terminals of each pair being less than the distance Q (or R). See FIG. 7. That is, crosstalk was found to be significantly reduced when a line 28 drawn from the midpoint of one terminal pair (e.g., pair 22) to the midpoint of the other terminal pair (e.g., pair 20) forms substantially a 45-degree angle with the plane containing the other terminal pair.

Figure 3:
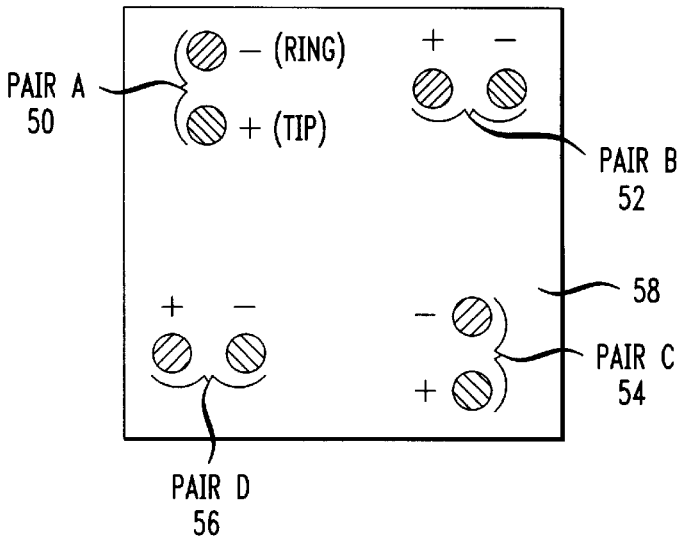
FIG. 3 is a cross-sectional representation of a low crosstalk configuration for three or four pairs of connector terminals.

To arrive at a low crosstalk connector interface for use in applications now met with four terminal pair (8 terminal) modular type telephone connectors, the configurations or relationships of FIGS. 1 and 2 are applied to cancel or minimize crosstalk between all six combinations of four differential (tip/ring) terminal pairs 50, 52, 54 and 56, shown in FIG. 3. In FIG. 3, the terminal pair configuration of FIG. 1 is applied to combinations of differential terminal pairs 50 and 52, pairs 50 and 56, pairs 52 and 54, and pairs 54 and 56, wherein each of these terminal pair combinations is situated at opposite ends of a side of an approximately square terminal configuration on a terminal face 58. The configuration of FIG. 2 is applied to the remaining combinations of differential terminal pairs 50 and 54, and pairs 52 and 56, wherein each of the remaining terminal pair combinations are at diagonally opposite corners of the configuration.

In practical applications there is a need to provide miniature connectors in order to reduce space required for outlets, and to reduce the size of mount openings in panels. Significantly, the terminal configuration of FIG. 3 can be used in applications now met with telephone type modular connectors such as, for example, the earlier mentioned RJ-45. That is, the FIG. 3 configuration will exhibit significantly superior crosstalk levels in an envelope size less than that of current modular connectors.

The following data was obtained using two envelope sizes of the four-pair, differential connector terminal configuration of FIG. 3. Crosstalk performance was measured at 100 MHz. Version 1 is for a square terminal configuration measuring 0.550 inches on a side. Version 2 is for a square configuration measuring 0.450 inches on a side. Differential terminal pairs A, B, C, D correspond to the same-lettered pairs in FIG. 3.

VERSION 1

| Terminal Pair | Crosstalk (dB down) |
|---|---|
| A-B (adjacent) | 84.6 |
| A-C (diagonal) | 107 (in noise floor) |
| A-D (adj.) | 79.1 |
| B-C (adj.) | 85.1 |
| B-D (diag.) | 96.5 (near floor) |
| C-D (adj.) | 106 (in noise floor) |

VERSION 2

| Terminal Pair | Crosstalk (dB down) |
|---|---|
| A-B (adjacent) | 72.8 |
| A-C (diagonal) | 87.1 |
| A-D (adj.) | 70.5 |
| B-C (adj.) | 76.7 |
| B-D (diag.) | 81.5 |
| C-D (adj.) | 74.2 |

The above data demonstrates that the connector configuration of FIG. 3 can be applied in plugs and jacks used to connect copper wire cables that transmit data at relatively high rates. The configuration will achieve significantly low electrical crosstalk between data transmitting pairs of cable conductors. Until now, crosstalk has been a common problem with connectors used in high data rate cable transmission applications.

Figure 4:
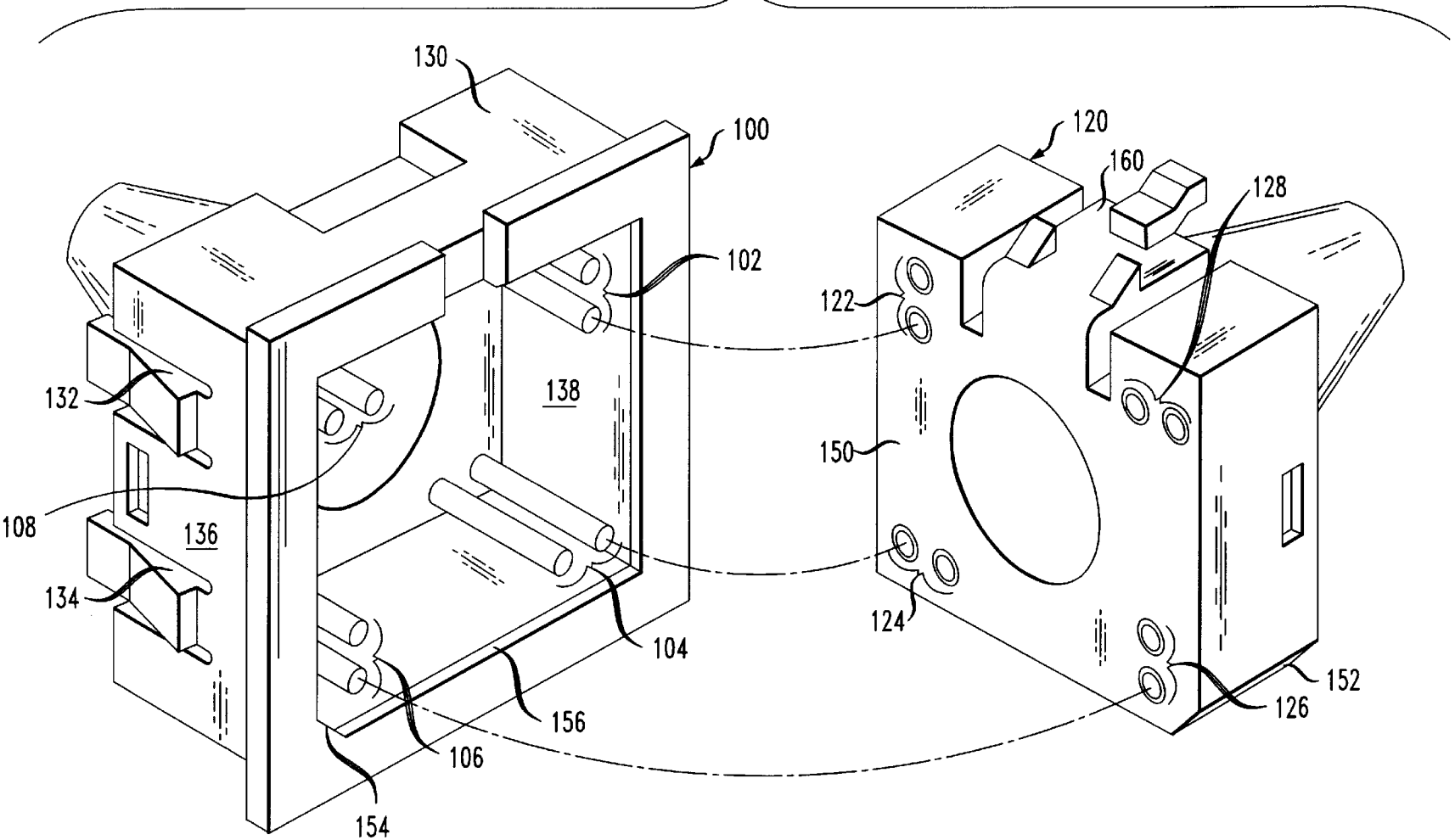
FIG. 4 is a view of an electrical jack connector and a mating plug connector each having the terminal pair configuration of FIG. 3.

FIG. 4 is a view showing an electrical jack connector 100 with elongate connector pin terminal pairs 102, 104, 106, 108; and a mating plug connector 120 with elongate connector socket terminal pairs 122, 124, 126, 128; according to the invention. The jack connector 100 has a generally rectangular outer frame body 130, with pairs of resilient snaps 132, 134 projecting outwardly from opposed side walls 136, 138 of the connector 100. The outer dimensions of the frame body 130 and its mounting parts may, for example, be compatible with mounts or panel openings that currently accept a type RJ-45 jack connector. Such would facilitate the replacement of existing modular connectors with those of the invention.

The plug connector 120 has a generally square connector terminal face 150 with an oblique "key" 152 cut at one corner of the face 150. The key 152 ensures that the plug connector 150 can be inserted with only one (i.e., proper) orientation in the jack connector 100 whose frame body 130 has a corresponding key 154 at a corner of a plug receiving opening 156 in the body 130. When the plug connector is properly inserted in the jack receiving opening 156, the jack connector pin terminal pairs 102, 104, 106, 108 engage corresponding plug connector socket terminal pairs 122, 124, 126, 128 in electrical conducting relation. Preferably, the plug connector 120 has a bendable snap catch 160 formed to project from a side wall of the connector face 150. The catch 160 engages an edge of the plug receiving opening 156 in the jack frame body 130, when the plug connector 120 is fully inserted in the jack receiving opening 156.

Figure 5:
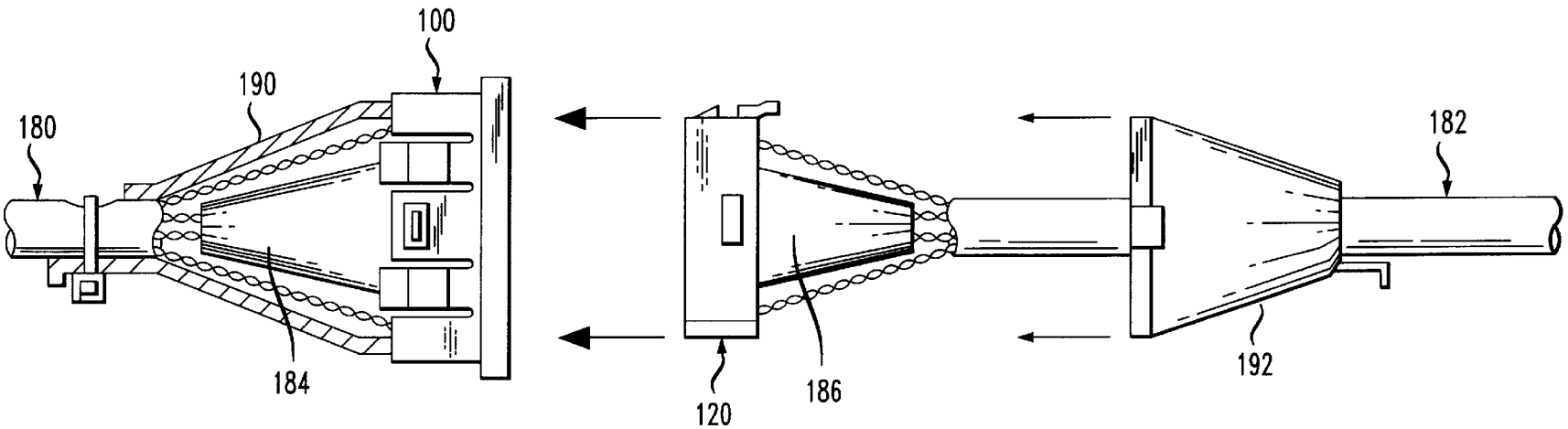
FIG. 5 is a side view showing further construction details of the mating jack and plug connectors of FIG. 4.

FIG. 5 is a side view of the connectors 100, 120 in FIG. 4 with associated wire cables 180, 182. The jack connector 100 has a generally conical portion 184 projecting axially toward the rear of the connector 100. The connector 120 also has a conical portion 186 projecting axially rearward. The conical portions 184, 186 serve to guide twisted wire pairs of the cables 180, 182 as they transition from the cables to connect with terminals of the associated connectors 100, 120. The conical portions 184, 186 may also have axially directed ribs or slots (not shown) to limit lateral movement of the wires. Each connector 100, 120 also has an associated conical housing 190, 192. The housings have rear openings that permit passage of an associated cable 180, 182 and the housings are fitted on the connectors over the conical portions 184, 186, with the twisted wire pairs protectively enveloped between the conical portions and the connector housings. It will be understood that FIG. 5 shows only one possible arrangement of connector/housing, and connectors can be constructed with other housings while still applying the terminal pair configuration shown in FIG. 3.

The connector terminal configuration of FIG. 3 combines two different electrical field relationships to achieve significantly low crosstalk levels in a connector for four twisted pairs of wires, without shielding. The connector can be used in applications where telephone type modular connectors are now used, that is, it can fit easily within the physical envelope of an existing modular connector, and can be used in voice and data transmitting applications. Moreover, in addition to enhanced performance, the disclosed connectors should cost no more, and will probably cost less to manufacture than existing modular connectors. Even more important, the connectors of the present invention will facilitate the use of copper cable transmission systems at data rates higher than those presently attained.

Figure 6:
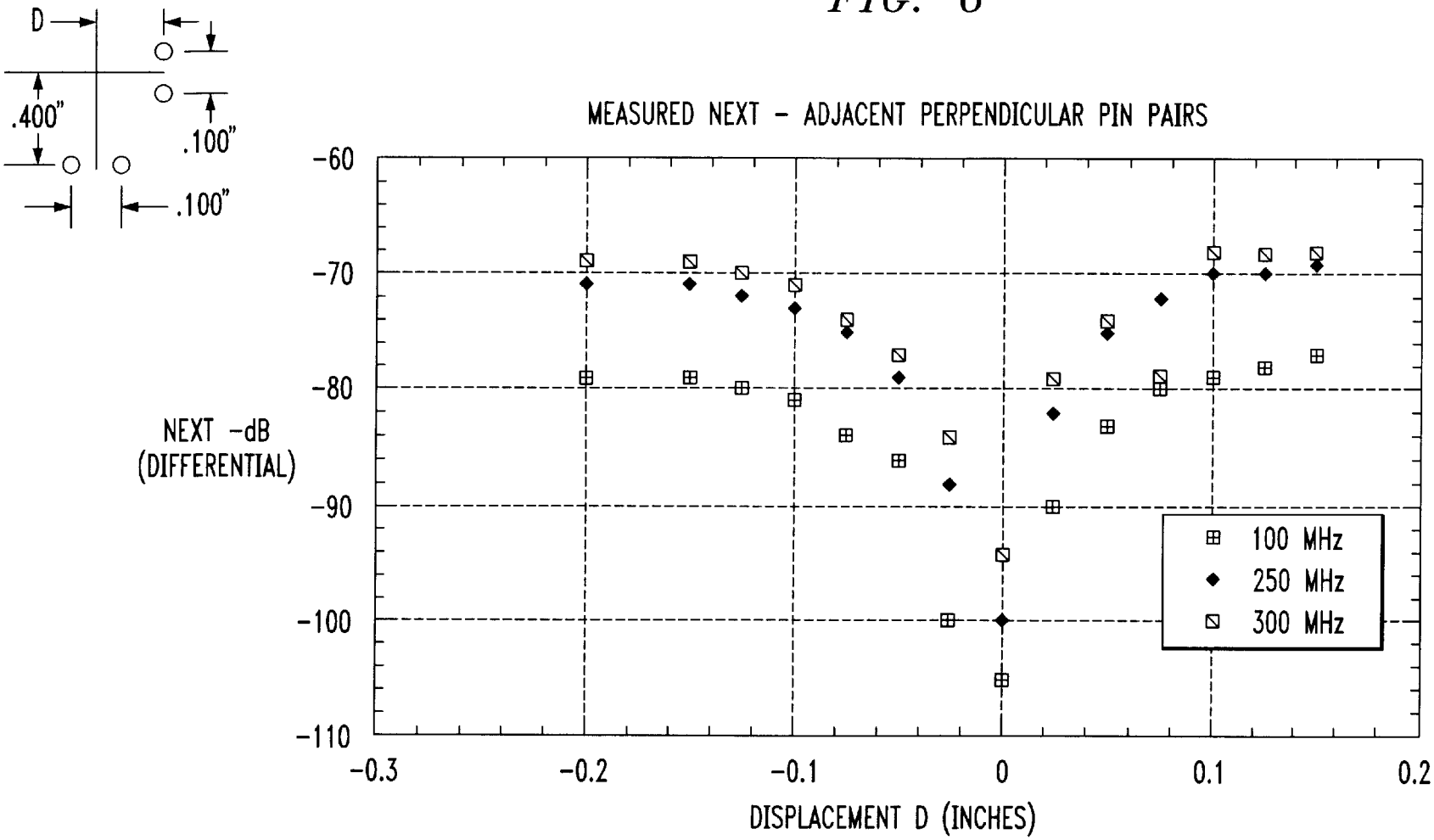
FIG. 6 is a graph of measured crosstalk between two pairs of electrical connector terminals when in the configuration of FIG. 1, and when in relative positions that approach the configuration of FIG. 1.
Figure 7:
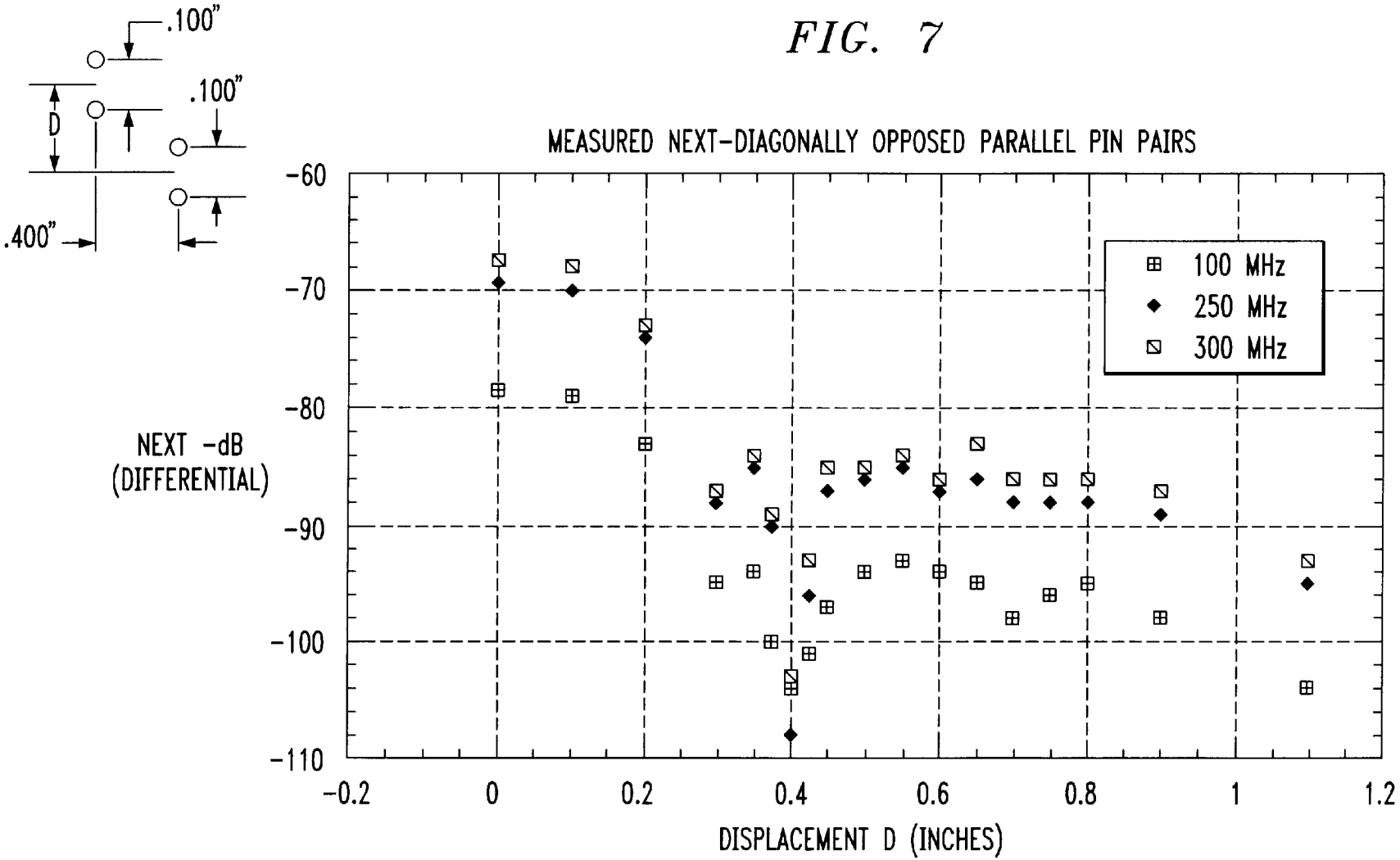
FIG. 7 is a graph of measured crosstalk between two pairs of electrical connector terminals when in the configuration of FIG. 2, and when in relative positions that approach the configuration of FIG. 2.

FIGS. 6 and 7 show plots of near-end crosstalk (NEXT) measurements obtained between two pairs of pin terminals when configured as in FIGS. 1 and 2, respectively, and at relative positions approaching the configurations of FIGS. 1 and 2. The measurement data in FIGS. 6 and 7 were obtained at frequencies of 100, 250 and 300 MHz, as shown by corresponding measurement point symbols on the graphs. Spacing between the terminals of each pair was set at 0.100 inches.

FIG. 6 shows that when the terminal pairs are aligned in perpendicular planes, as in FIG. 1, and the plane of the second terminal pair is displaced to coincide with the midpoint (D=0) of the first terminal pair as in FIG. 1, measured NEXT was at a minimum value of less than −95 dB at each of the three frequencies tested. Significantly, when the plane of the second terminal pair coincided with either of the first terminals (at D=−0.05 and +0.05 inches) to simulate the configuration disclosed in the mentioned '040 patent, measured NEXT increased significantly by about 20 dB.

The graph of FIG. 7 shows that when the terminal pairs are aligned in parallel planes, and the distance (D) between midpoints of the terminal pairs in a direction parallel to the planes is equal to the distance between the midpoints in a direction perpendicular to the planes as in FIG. 2, measured NEXT was at a minimum value of less than −100 dB at each of the three frequencies tested. Significantly, as the second terminal pair was displaced farther from the optimum (0.400 inch) position relative to the first terminal pair, measured NEXT initially increased by about 20 dB. This demonstrates that, contrary to the known art including the '040 patent, NEXT may not always decrease as the spacing between parallel pairs of contact terminals or pins increases. That is, the measured data show that a terminal configuration in which the spacing between all terminal pairs is maximized within a given (e.g., square) boundary, will not always achieve the greatest possible overall crosstalk performance for a connector.

While the foregoing description represents preferred embodiments of the invention, it will be obvious to those skilled in the art that various changes and modifications may be made without departing from the true spirit and scope of the invention pointed out by the following claims. For example, for applications requiring only three terminal pairs, the terminal pair configuration of FIG. 3 may be modified by eliminating one of the terminal pairs and leaving the other three in place on the terminal face. Further, the terminal configurations of FIGS. 1, 2 and 3 may be combined and repeated across a terminal face of most any dimensions, in order to accommodate more than four pairs of terminals all with extremely low crosstalk.

We claim:

1. A low crosstalk connector configuration, comprising:

a connector terminal face having an approximately square terminal configuration;

at least three pairs of elongated parallel electrical connector terminals, wherein each pair of terminals is situated at a different corner of the configuration and is aligned in a plane normal to the terminal face;

a first pair of electrical connector terminals at a first corner of the configuration is aligned in a first plane that is substantially parallel to a second plane in which a second pair of terminals at a second corner diagonally opposite the first corner, is aligned;

a first separation distance between midpoints of the first and the second pairs of electrical connector terminals in a direction parallel to said planes, is substantially equal to a second separation distance between the midpoints in a direction perpendicular to said planes; and a third pair of electrical connector terminals at a third corner of the configuration is aligned in a third plane that is perpendicular to the first and the second planes, and said third plane coincides with a point between either of the first or the second pair of terminals.

2. A connector configuration according to claim 1, wherein side dimensions of the terminal face are at most about 0.650 inches.

3. A connector configuration according to claim 1, wherein at least some of said electrical connector terminals are pin terminals.

4. A connector configuration according to claim 1, wherein at least some of said electrical connector terminals are socket terminals.

5. A connector configuration according to claim 1, wherein said third plane coincides with a midpoint between either of the first or the second pair of terminals.

6. A connector configuration according to claim 1, including a fourth pair of elongated parallel electrical connector terminals supported at a fourth corner of the terminal configuration, wherein the fourth pair of terminals is aligned in a fourth plane normal to the terminal face;

wherein the fourth plane is substantially perpendicular to the first and the second planes and coincides with a point between either of the first or the second pair of terminals, and the fourth plane is substantially parallel to the third plane; and a first separation distance between midpoints of the fourth and the third pairs of terminals in a direction parallel to the fourth and the third planes, is substantially equal to a second separation distance between said midpoints in a direction perpendicular to the fourth and the third planes.

7. A connector configuration according to claim 6, including a length of cable comprising four pairs of twisted wires that are electrically connected to corresponding pairs of said connector terminals.

8. A connector configuration according to claim 6, wherein said fourth plane coincides with a midpoint between either of the first or the second pair of terminals.

9. A connector configuration according to claim 1, including a generally conical connector part extending axially rearward from the terminal face, the part being configured to limit lateral movements of cable wire pairs that transition between an associated cable and the connector terminals.

10. A connector configuration according to claim 9, including a generally conical housing constructed and arranged to fit over the conical connector part with said wire pairs enveloped between the part and said housing.

11. A cable and connector assembly, comprising:

a length of cable having at least three pairs of twisted wires; and a connector attached to one end of said cable, said connector having a terminal face and an approximately square connector terminal configuration; and at least three pairs of elongated parallel electrical connector terminals, wherein each pair of terminals is situated at a different corner of the configuration and is aligned in a plane normal to the terminal face;

a first pair of electrical connector terminals at a first corner of the configuration is aligned in a first plane that is substantially parallel to a second plane in which a second pair of terminals at a second corner diagonally opposite the first corner, is aligned; and a first separation distance between midpoints of the first and the second pairs of electrical connector terminals in a direction parallel to said planes, is substantially equal to a second separation distance between the midpoints in a direction perpendicular to said planes; and a third pair of electrical connector terminals at a third corner of the configuration is aligned in a third plane that is perpendicular to the first and the second planes, and said third plane coincides with a point between either of the first or the second pair of terminals;

wherein said pairs of twisted wires of the cable are electrically connected to corresponding pairs of said connector terminals.

12. A cable and connector assembly according to claim 11, wherein side dimensions of the terminal face are at most about 0.650 inches.

13. An assembly according to claim 11, wherein at least some of said electrical connector terminals are pin terminals.

14. An assembly according to claim 11, wherein at least some of said electrical connector terminals are socket terminals.

15. An assembly according to claim 11, wherein said third plane coincides with a midpoint between either of the first or the second pair of terminals.

16. A cable and connector assembly according to claim 11, including a fourth pair of elongated parallel electrical connector terminals supported at a fourth corner of the terminal configuration, wherein the fourth pair of terminals is aligned in a fourth plane normal to the terminal face; and wherein the fourth plane is substantially perpendicular to the first and the second planes and coincides with a point between either of the first or the second pair of terminals, and the fourth plane is substantially parallel to the third plane; and a first separation distance between midpoints of the fourth and the third pairs of terminals in a direction parallel to the fourth and the third planes, is substantially equal to a second separation distance between said midpoints in a direction perpendicular to the fourth and the third planes.

17. A cable and connector assembly according to claim 16, wherein said length of cable comprises four pairs of twisted wires that are electrically connected to corresponding pairs of said connector terminals.

18. An assembly according to claim 16, wherein said fourth plane coincides with a midpoint between either of the first or the second pair of terminals.

19. An assembly according to claim 11, including a generally conical connector part extending axially rearward from the terminal face, the connector part being configured to limit lateral movement of said twisted wire pairs that transition between said cable and the connector terminals.

20. An assembly according to claim 19, including a generally conical housing constructed and arranged to fit over the conical connector part with said wire pairs enveloped between the part and said housing.

21. A low crosstalk connector configuration, comprising:

a connector terminal face;

at least three pairs of elongated, parallel electrical connector terminals, wherein each pair of terminals is aligned in a plane normal to the terminal face;

a first pair of the electrical connector terminals is aligned in a first plane that is substantially parallel to a second plane in which a second pair of the terminals is aligned;

a first separation distance between midpoints of the first and the second pairs of terminals in a direction parallel to said planes, is substantially equal to a second separation distance between the midpoints in a direction perpendicular to the planes; and a third pair of the terminals is aligned in a third plane that is perpendicular to the first and the second planes, and the third plane coincides with a point between either of the first or the second pair of terminals.

22. A connector configuration according to claim 21, wherein at least some of the electrical connector terminals are pin terminals.

23. A connector configuration according to claim 21, wherein at least some of the electrical connector terminals are socket terminals.

24. A connector configuration according to claim 21, wherein the third plane coincides with a midpoint between either of the first or the second pair of terminals.

25. A connector configuration according to claim 21, including a fourth pair of elongated parallel electrical connector terminals, wherein the fourth pair of terminals is aligned in a fourth plane normal to the terminal face;

wherein the fourth plane is substantially perpendicular to the first and the second planes and coincides with the point between either of the first or the second pair of terminals, and the fourth plane is substantially parallel to the third plane; and a first separation distance between midpoints of the fourth and the third pairs of terminals in a direction parallel to the fourth and the third planes, is substantially equal to a second separation distance between said midpoints in a direction perpendicular to the fourth and the third planes.

26. A connector configuration according to claim 25, including a length of cable comprising four pairs of twisted wires that are electrically connected to corresponding pairs of the connector terminals.

27. A connector configuration according to claim 25, wherein the fourth plane coincides with a midpoint between either of the first or the second pair of terminals.

28. A connector configuration according to claim 25, including more than four pairs of electrical connector terminals.

29. A cable and connector assembly, comprising:

a length of cable having at least three pairs of twisted wires;

a connector attached to one end of the cable, said connector having a terminal face; and at least three pairs of elongated parallel electrical connector terminals, wherein each pair of terminals is aligned in a plane normal to the terminal face;

a first pair of the electrical connector terminals is aligned in a first plane that is substantially parallel to a second plane in which a second pair of the terminals is aligned;

a first separation distance between midpoints of the first and the second pairs of terminals in the direction parallel to said planes, is substantially equal to a second separation distance between the midpoints in a direction perpendicular to the planes; and a third pair of the terminals is aligned in a third plane that is perpendicular to the first and the second planes, and the third plane coincides with a point between either of the first or the second pair of terminals;

wherein said pairs of twisted wires of the cable are electrically connected to corresponding pairs of the connector terminals.

30. An assembly according to claim 29, wherein at least some of the electrical connector terminals are pin terminals.

31. An assembly according to claim 29, wherein at least some of the electrical connector terminals are socket terminals.

32. An assembly according to claim 29, wherein the third plane coincides with a midpoint between either of the first or the second pair of terminals.

33. A cable and connector assembly according to claim 29, including a fourth pair of elongated parallel electrical connector terminals, wherein the fourth pair of terminals is aligned in a fourth plane normal to the terminal face; and wherein the fourth plane is substantially perpendicular to the first and the second planes and coincides with a point between either of the first or the second pair of terminals, and the fourth plane is substantially parallel to the third plane; and a first separation distance between midpoints of the fourth and the third pairs of terminals in a direction parallel to the fourth and the third planes, is substantially equal to a second separation distance between the midpoints in a direction perpendicular to the fourth and the third planes.

34. A cable and connector assembly according to claim 33, wherein said length of cable comprises four pairs of twisted wires that are electrically connected to corresponding pairs of said connector terminals.

35. An assembly according to claim 33, wherein the fourth plane coincides with a midpoint between either of the first or the second pair of terminals.

36. A connector configuration according to claim 33, including more than four pairs of electrical connector terminals.

* * * * *